US007793935B2

(12) United States Patent
Wang

(10) Patent No.: US 7,793,935 B2
(45) Date of Patent: Sep. 14, 2010

(54) FEEDING PAPER APPARATUS AND FEEDING PAPER METHOD THEREOF

(75) Inventor: Chih-Hwa Wang, Shenkeng Township, Taipei County (TW)

(73) Assignee: Kinpo Electronics, Inc., Taipei County (TW)

( * ) Notice: Subject to any disclaimer, the term of this patent is extended or adjusted under 35 U.S.C. 154(b) by 296 days.

(21) Appl. No.: 12/153,286

(22) Filed: May 16, 2008

(65) Prior Publication Data

US 2009/0212496 A1 Aug. 27, 2009

(30) Foreign Application Priority Data

Feb. 22, 2008 (TW) ..... 97106383 A

(51) Int. Cl.
*B65H 5/06* (2006.01)

(52) U.S. Cl. ..... 271/274; 271/272

(58) Field of Classification Search ..... None
See application file for complete search history.

(56) References Cited

U.S. PATENT DOCUMENTS 4,023,791 A * 5/1977 Hori et al. ..... 271/273
5,182,861 A * 2/1993 Suzuki et al. ..... 271/273
5,199,702 A * 4/1993 Davis et al. ..... 271/274
5,203,846 A * 4/1993 Kuhns et al. ..... 271/274

* cited by examiner

*Primary Examiner*—Gene Crawford
*Assistant Examiner*—Gerald W McClain
(74) *Attorney, Agent, or Firm*—Rosenberg, Klein & Lee

(57) ABSTRACT

A feeding paper apparatus includes a rod having a fulcrum member thereon, and two pressing unit disposed on the opposite ends of the rod. Each pressing unit has a connecting device disposed on the rod, a buffering device movably and pivotally disposed on the connecting device, and a pressing wheel rotatably disposed on the buffering device. The pressing wheels provide the same component force on the corresponding feeding paper wheel so as to improve the quality of feeding paper. Furthermore, a method for using the feeding paper apparatus is disclosed.

10 Claims, 5 Drawing Sheets

FEEDING PAPER APPARATUS AND FEEDING PAPER METHOD THEREOF

BACKGROUND OF THE INVENTION

1. Field of the Invention

The present invention relates to a feeding paper apparatus and a feeding paper method using the same, and in particular to a feeding paper apparatus method for outputting equal feeding force.

2. Description of Prior Art

Computers are widely used in the modern life and printers are popular outputting machines for outputting data stored in a computer. Consumers choose a printer depending on the printing quality. Furthermore, the considerations such as printing rate, printing stability and printing reliability are also believed as an important performance when end-users buy a printer. High printing stability relies on the well-controlled feeding mechanism. Basically, the feeding mechanism has many parts, such as drawing paper from different trays and driving the single piece of paper to move by a wheel. The paper is fed into the printer and the selected data is printed on the paper.

However, the wheels are connected on the axle in the traditional feeding mechanism. Due to the errors of manufacturing or assembling, the wheels may output force with different quantities. The paper is driven by different forces so that the parts of paper can not move in the same speed and then paper jams occur. A flexible axle has been developed for solving the problem. The flexible axle is simply made of elastic material, but the correcting range is too small to compensate efficiently for the different forces.

Therefore, in view of this, the inventor proposes the present invention to overcome the above problems based on his expert experience and deliberate research.

SUMMARY OF THE INVENTION

The primary object of the present invention is provided for a feeding paper apparatus and a feeding paper method using the same. Each pressing unit of the feeding paper apparatus can output the same component on a corresponding feeding paper wheel so that paper is driven to feed in a machine by the same feeding friction.

In order to achieve the above object, the present invention provides a feeding paper apparatus comprising: a rod; two pressing units disposed on opposite ends of the rod, wherein each pressing unit comprises: a connecting device connected with the rod; a buffering device movably pivoted on one end to the connecting device; and a pressing wheel rotatably disposed on other end of the buffering device; and a fulcrum member disposed on the rod and between the two pressing units; wherein each pressing wheel operates in coordination with a feeding paper wheel for feeding paper.

In order to achieve the above object, the present invention further provides a feeding paper apparatus comprising: a rod; a first pressing module and a second pressing module disposed on opposite ends of the rod, wherein the first pressing module has a first number of pressing units and the second pressing module has a second number of pressing units, each pressing unit comprises: a connecting device; a buffering device, wherein one end of the buffering device is movably pivoted on the connecting device; and a pressing wheel rotatably disposed on other end of the buffering device; and a fulcrum member disposed on the rod and between the two pressing units; wherein each pressing wheel operates in coordination with a feeding paper wheel for feeding paper.

In order to achieve the above object, the present invention still further provides a feeding paper method comprising: providing a feeding paper unit having a plurality of feeding paper wheels, and assembling a feeding paper apparatus on the feeding paper unit, the feeding paper apparatus comprising: a rod; two pressing units disposed on opposite ends of the rod, wherein each pressing unit comprises: a connecting device connected with the rod; a buffering device, wherein one end of the buffering device is movably pivoted on the connecting device; and a pressing wheel rotatably disposed on other end of the buffering device; and a fulcrum member disposed on the rod and between the two pressing units; wherein each pressing wheel operates in coordination with a feeding paper wheel for feeding paper; wherein distances between the two connecting units and the fulcrum are changeable for balanced the torques relative to the fulcrum member, lengths of the two buffering units are changeable so that the pressing wheels output the same force on the corresponding paper wheels in order to form equal feeding force on the corresponding pressing wheels and the feeding paper wheel.

In the present invention, when the torques are not balanced, the positions of pressing units or fulcrum member are changed so that the forces arm defined between each pressing unit and the fulcrum are equal to each other in order to output the same components on each feeding paper wheel. Therefore, the problems of "paper jam" and "different feeding force" are solved.

In order to better understand the characteristics and technical contents of the present invention, a detailed description thereof will be made with reference to the accompanying drawings. However, it should be understood that the drawings and the description are illustrative but not used to limit the scope of the present invention.

DETAILED DESCRIPTION OF THE INVENTION

Figure 1:
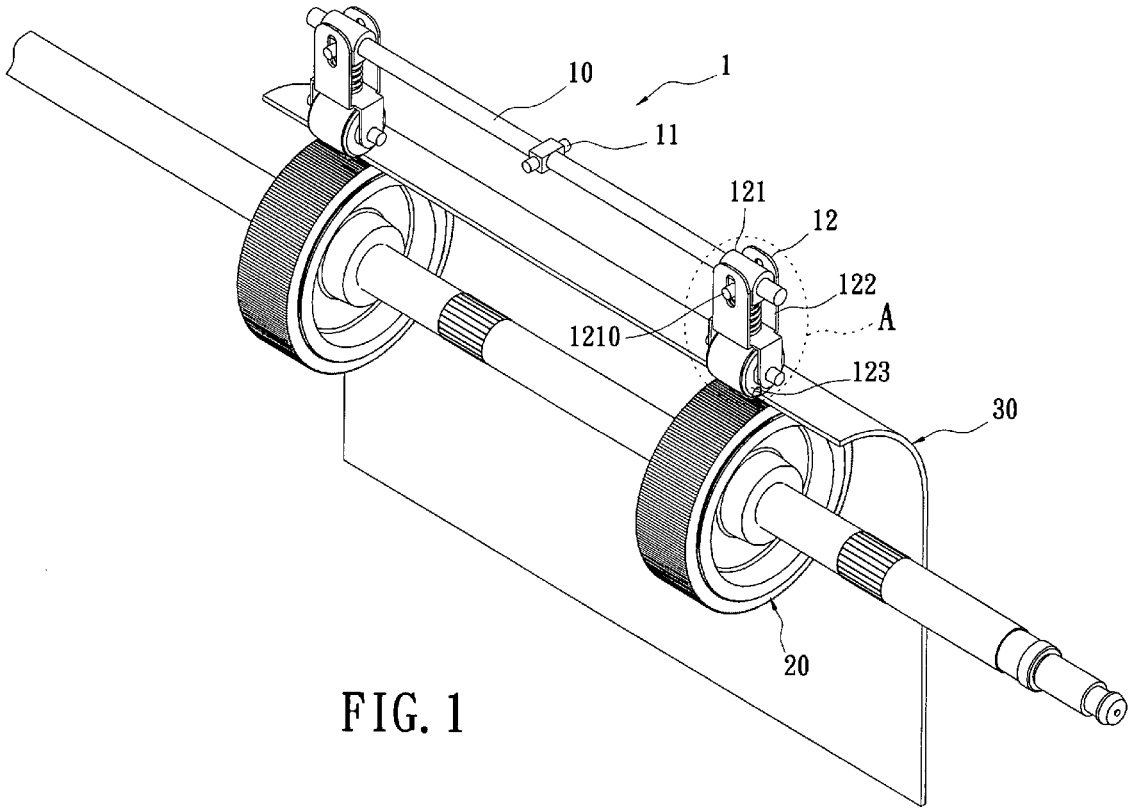
FIG. 1 is a schematic view showing the feeding paper apparatus according to the present invention.
Figure 2:
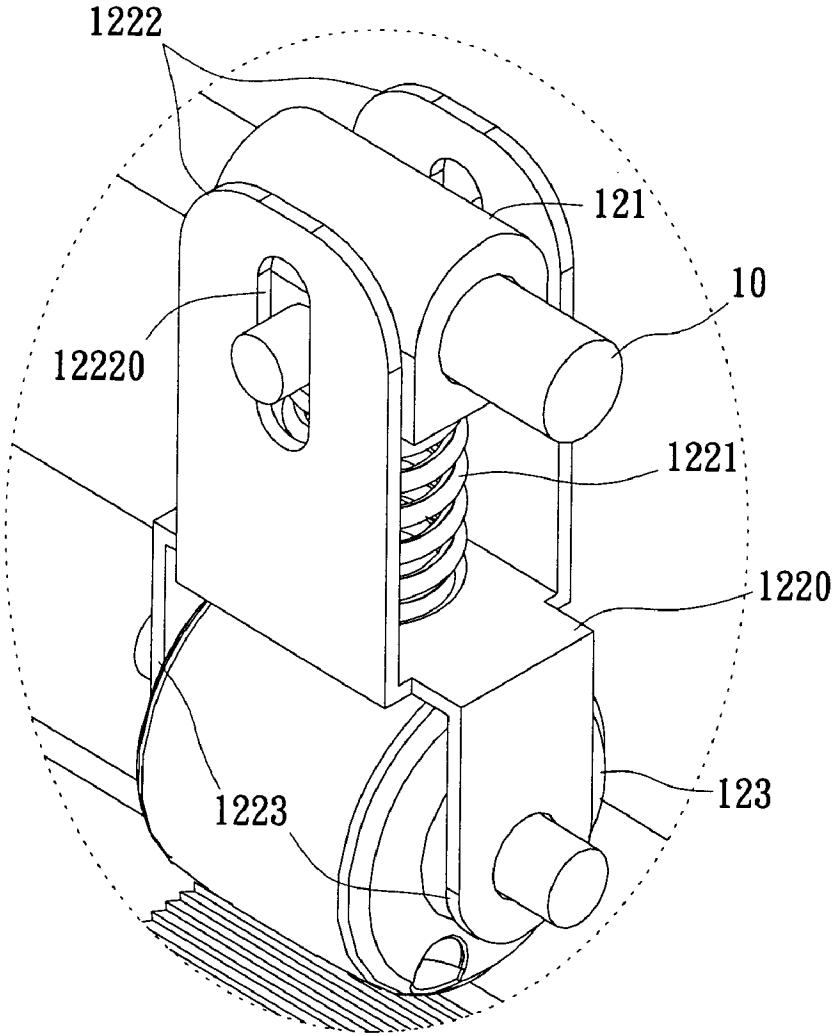
FIG. 2 is a large view showing part A in FIG. 1.

Please refer to FIGS. 1 and 2, the invention discloses a feeding paper apparatus 1 and a feeding paper method using the same. The feeding paper apparatus 1 is used for achieving a better paper-feeding quality. The feeding paper apparatus 1 has a rod 10, two pressing units 12 disposed on opposite ends of the rod 10, and a fulcrum member 11 disposed on the rod 10 and located between the two pressing units 12. The pressing unit 12 has a connecting device 121 connected with the rod 10, a buffering device 122 movably pivoted on one end to the connecting device 121; and a pressing wheel 123 rotatably disposed on other end of the buffering device 122. The rod 10 bears a fulcrum member 11 at its middle portion. In the first embodiment, the fulcrum member 11 is fixed on the rod 10 and the two connecting devices 121 of the two pressing units 12 move slidably along the rod 10 and relatively to the fulcrum member 11. The fulcrum member 11 is pivoted on a printer or other device with a paper feeding mechanism. Depending on the fulcrum member 11, the rod 10 can rotate centered at the fulcrum member 11 for adjusting the angle of the rod 10. The pressing wheel 123 outputs a force upon a feeding paper wheel 20 when paper is fed between the pressing wheel 123 and the feeding paper wheel 20.

Furthermore, the two connecting devices 121 of the two pressing units 12 move slidably along the rod 10 so that the two pressing units 12 move relatively to the fulcrum member 11. Preferably, two sides of each connecting device 121 have a protrusion 1210.

The buffering device 122 of the pressing units 12 further comprises a main plate 1220 and an elastic member 1221 and two ends of the elastic member 1221 respectively abut against the connecting device 121 and the main plate 1220. The main plate 1220 further has two first plates 1222 extending upwards from two opposite sides of the main plate 1220 and two second plates 1223 extending downwards from two other opposite sides of the main plate 1220. Each of the first plate 1222 has a longitudinal hole 12220 corresponding to the protrusion 1210 of the connecting device 121. Depending on the protrusion 1210 and the longitudinal hole 12220, the buffering device 122 is connected pivotally with the connecting device 121 so that the buffering device 122 can rotate relatively to the rod 10. The buffering device 122 rotates to maintain its extending direction parallel to the direction of the feeding paper wheel 20 (in longitudinal direction). On the other hand, depending on the length of the hole 12220, the elastic member 1221 can be shortened or extended so that the length of the buffering device 122 in longitudinal direction can be changed. In the embodiment, the elastic member 1221 is a spring, but not restricted thereto.

The pressing wheel 123 of the pressing units 12 is rotatably pivoted between the two second plates 1223 of the buffering device 122. The pressing wheel 123 operates in coordination with the feeding paper wheel 20 so as to feeding paper. The corresponding pressing wheel 123 and the feeding paper wheel 20 rotate in opposite directions, moving the paper by means of friction.

Figure 3A:
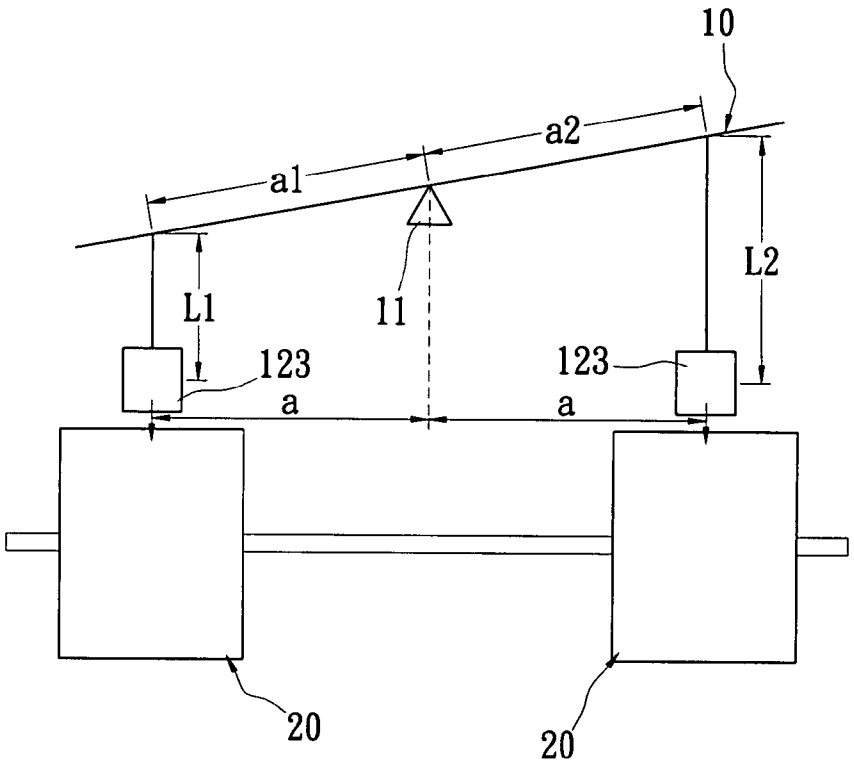
FIG. 3A is a simplified view showing the feeding paper apparatus in another situation according to the present invention.
Figure 3:
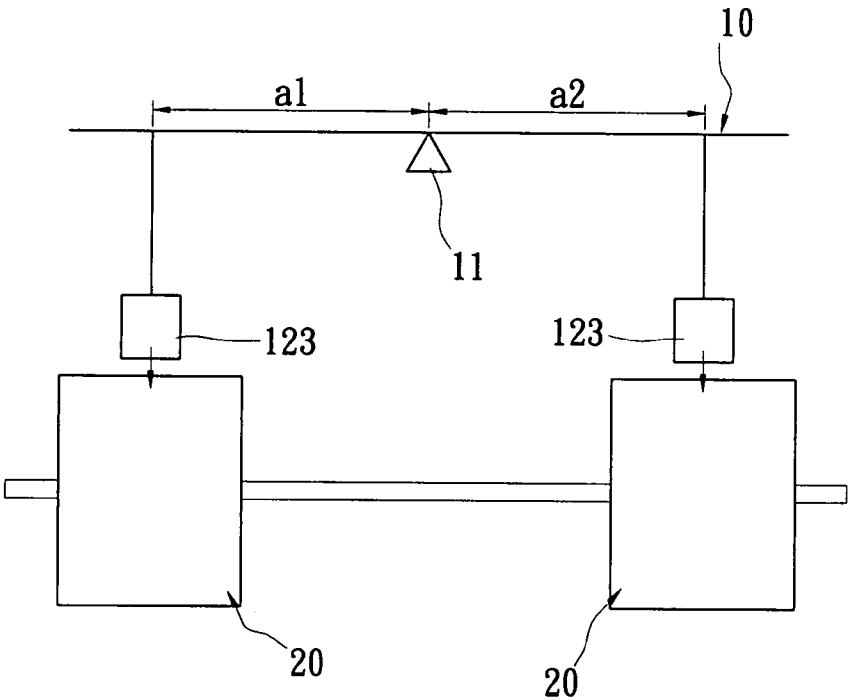
FIG. 3 is a simplified view showing the feeding paper apparatus in one situation according to the present invention.

Please refer to FIGS. 3 and 3A, the application of feeding paper apparatus 1. Note that the connecting device 121 and the buffering device 122 are omitted in FIGS. 3 and 3A for the sake of simplicity. The feeding paper apparatus 1 is assembled on a printer and the pressing wheels 123 of the feeding paper apparatus 1 are corresponding to the feeding paper wheels 20. In case that the feeding paper apparatus 1 are assembled with precision, the rod 10 remains the horizontal state (perpendicular to the longitudinal direction of the feeding paper wheel 20). In FIG. 3, the distances between the two pressing units 12 and the fulcrum member 11 are a1 and a2. For the reason of torque balance, the component forces (as arrow) of the two pressing units 12 on the feeding paper wheels 20 are the same in condition of a1=a2=a. Therefore, the friction between the corresponding pressing wheel 123 and the feeding paper wheel 20 are the same because of the same component forces outputted by the two pressing units 12.

Alternatively, as shown in FIG. 3A, if sizes of the components are not precise or the paper fed between the corresponding pressing wheel 123 and the feeding paper wheel 20 is lopsided, the torques of two sides of the rod 10 are not balanced so that the rod 10 will rotate centered at the fulcrum member 11. In other words, the rod 10 tilts because of the unbalanced torques. The two pressing units 12 slides on the rod 10 by the two connecting devices 121 and simultaneously, the lengths of the two pressing units 12 are shortened or lengthened by extending or compressing the elastic member 1221 so that the two pressing units 12 at last have different lengths. On the other hand, because the buffering device 122 pivots on the connecting device 121, the buffering device 122 holds its position in longitude (shown in FIG. 2) so that the pressing wheel 123 can output a component force on the corresponding feeding paper wheel 20. At last, the two pressing units 12 have equal force arms (a) relative to the fulcrum member 11, although the distance between the left pressing unit 12 and the fulcrum member 11 is a1, and the distance between the right pressing unit 12 and the fulcrum member 11 is a2. Furthermore, by the shortened elastic member 1221 of the buffering device 122 of the left pressing unit 12 and the extended elastic member 1221 of the buffering device 122 of the right pressing unit 12, the longitudinal lengths of the two pressing units 12 are L1 and L2 so that the pressing wheel 123 disposed on the pressing unit 12 can effectively abut the paper 30 on the surface of the corresponding feeding paper wheel 20 so that the component force outputted by each pressing wheel 123 on the corresponding feeding paper wheel 20 are equal. In other words, the friction between each corresponding pressing wheel 123 and feeding paper wheel 20 is the same so that paper 30 moves smoothly and with the same speed between the corresponding pressing wheels 123 and feeding paper wheels 20 because of the equal feeding force even if the paper 30 is not leveling.

Accordingly, the method for using the feeding paper apparatus 1 is assembling the feeding paper apparatus 1 on a feeding paper unit, for example, a printer. When the two torques formed by the two pressing units 12 relative to the fulcrum member 11 are not equal. The rod 10 can rotate centered at the fulcrum member 11 so that the pressing units 12 can slide along the rod 10 via the two connecting devices 121. Simultaneously, the length of one pressing unit 12 increases by lengthening of its elastic member 1221 of the buffering device 122 and the length of the other pressing unit 12 decreases through the compression of its elastic member 1221 of the buffering device 122. At last, the two torques formed by the two pressing units 12 relative to the fulcrum member 11 will be equal so that the paper can be fed by the same friction of the corresponding pressing wheel 123 and feeding paper wheel 20. Accordingly, the problem of paper jam in the traditional printer is solved because of the equal feeding paper force.

Figure 4:
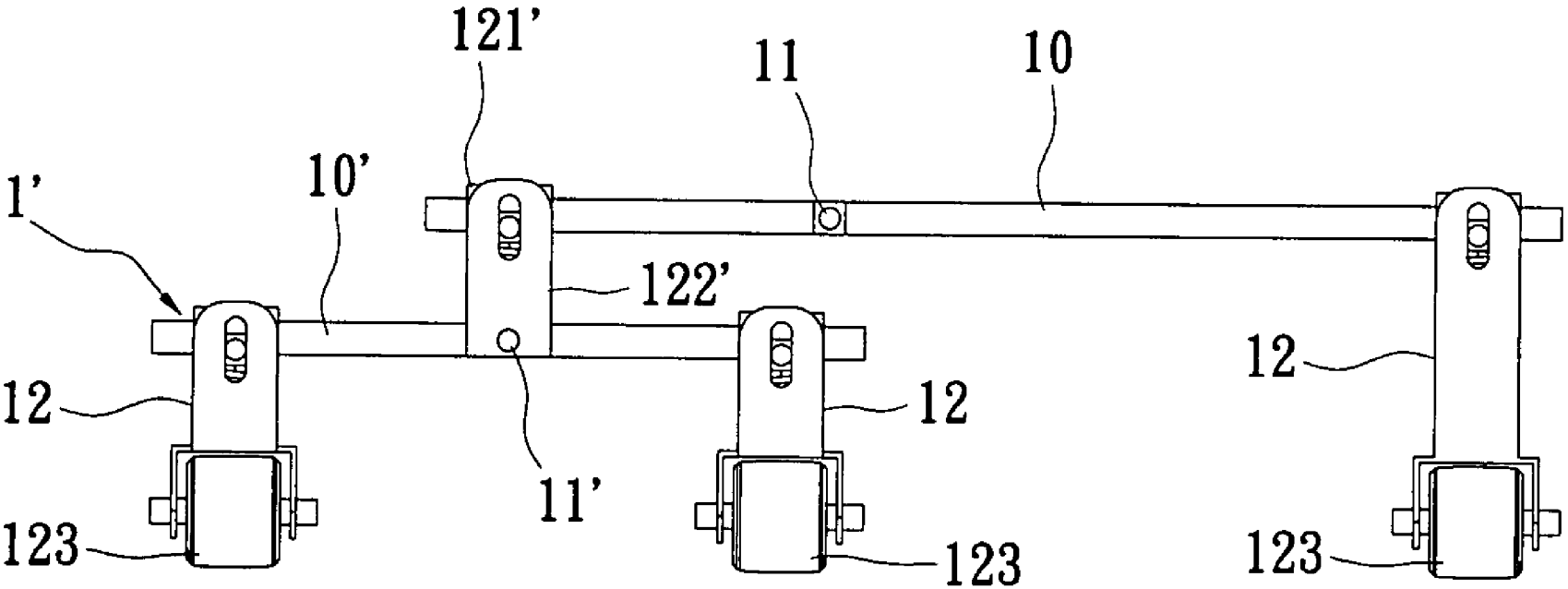
FIG. 4 is simplified representation showing the second embodiment of the feeding paper apparatus according to the present invention.

Please refer to FIG. 4, the second embodiment is shown. In the second embodiment, there are different numbers of the pressing units 12 disposed on the opposite end of the rod 10. For example, one pressing unit 12 is disposed on the right side of the fulcrum member 11 and two pressing units 12 are disposed on the left side of the fulcrum member 11. Note that the position of the fulcrum member 11 on the rod 10 has to be adjusted because of the different numbers of the pressing unit 12. Unlike the first embodiment, the fulcrum member 11 is not at the middle of the rod 10. Taking FIG. 4 for example, the two pressing units 12 disposed on the left end of the rod 10 are constructed as a first pressing module 1' and the one pressing unit 12 disposed on the right end of rod 10 is named as a second pressing module. Therefore, the ratio of a force arm defined between the first pressing module 1' and the fulcrum member 11 divided by a force arm defined between the second pressing module and the fulcrum member 11 is equal to a ratio of ½. In other words, if the first pressing module 1' has a first number of pressing units 12 and the second number of pressing units 12, the ratio of a force arm defined between the first pressing module 1' and the fulcrum member 11 divided by a force arm defined between the second pressing module and the fulcrum member 11 is equal to a ratio of the second number divided by the first number.

Moreover, the first pressing module 1' further comprises a auxiliary rod 10', and the two pressing units 12 are disposed on the opposite end of the first rod 10'. A first connecting device 121' is disposed on the rod 10, and a first buffering unit 122' is pivoted on the first connecting device 121'. The first buffering unit 122' connects to the first fulcrum member 121' of the first pressing module 1'. In other words, a third number of pressing units 12 and a fourth number of pressing units 12 are disposed on opposite ends of the auxiliary rod 10' so that each pressing wheel 123 can output the same component force on the corresponding feeding paper wheel 20 to feed the paper 30 as well as the first embodiment.

Figure 5:
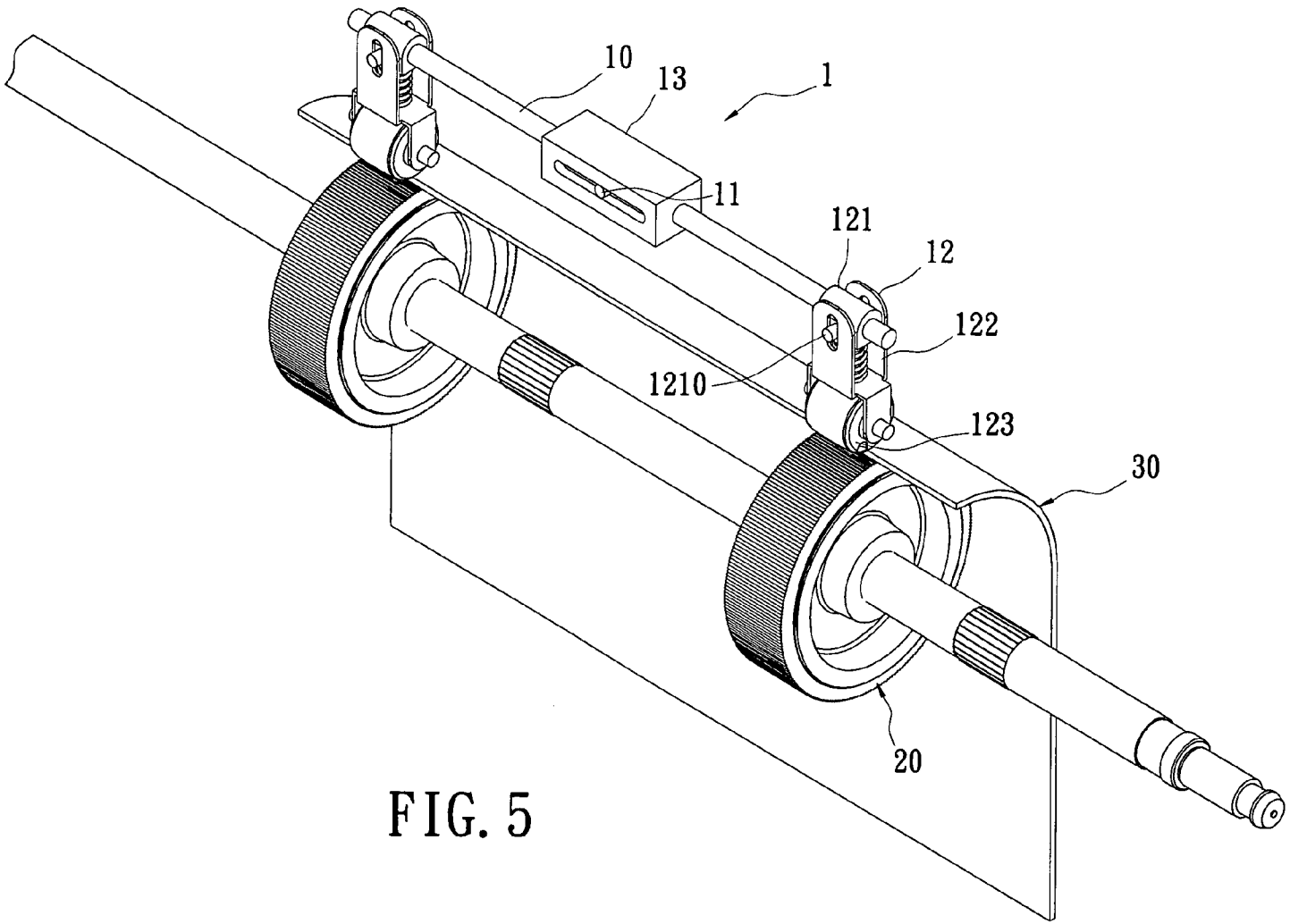
FIG. 5 is a schematic view showing the third embodiment of the feeding paper apparatus according to the present invention.

Please refer to FIG. 5, the third embodiment is disclosed. In the third embodiment, the two connecting devices 121 are fixed on the rod 10 and the fulcrum member 11 moves along the rod 10 and relatively to the connecting devices 121. In the third embodiment, the fulcrum member 11 can be driven by a pressure means 13 to move along the rod 10. When the torques of two sides of the rod 10 are not balanced, the fulcrum member 11 is driven by the pressure means 13 to move along the rod 10 so that the force arms defined between each pressing unit 12 and the fulcrum member 11 are equal so as to balance the torques on the two ends of the fulcrum member 11. However, the remaining devices not discussed are similar with the first and second embodiments.

To sum up, the present invention has the following advantages:

1. By balancing the torques, the component forces outputted by each pressing unit 12 are the same so that the pressures calculated between the corresponding pressing wheel 123 and feeding paper wheel 20 are the same. Therefore, the frictions used for feeding paper are the same.
2. There can be different numbers of pressing units 12 on the two sides of the fulcrum member 11 so that the feeding paper apparatus 1 can be applied for more different applications.

Although the present invention has been described with reference to the foregoing preferred embodiment, it will be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. A feeding paper apparatus, comprising:

a rod;

two pressing units disposed on opposite ends of the rod, wherein each pressing unit comprises:

a connecting device connected with the rod;

a buffering device movably pivoted on one end to the connecting device; and a pressing wheel rotatably disposed on other end of the buffering device; and a fulcrum member disposed on the rod between the two pressing units;

wherein each pressing wheel operates in coordination with a feeding paper wheel for feeding paper.

2. The feeding paper apparatus according to claim 1, wherein the fulcrum member is fixed on the rod and the two connecting devices move slidably along the rod and relatively to the fulcrum member.

3. The feeding paper apparatus according to claim 2, wherein two sides of each connecting device have a protrusion.

4. The feeding paper apparatus according to claim 3, wherein the buffering device further comprises a main plate and an elastic member and two ends of the elastic member abut against the connecting device and the main plate.

5. The feeding paper apparatus according to claim 4, wherein the main plate further has two first plates extending upwards from two opposite sides of the main plate and two second plates extending downwards from two other opposite sides of the main plate.

6. The feeding paper apparatus according to claim 5, wherein each of the first plates has a hole corresponding to the protrusion of the connecting device.

7. The feeding paper apparatus according to claim 6, wherein the pressing wheel is rotatably pivoted between the two second plates.

8. The feeding paper apparatus according to claim 1, wherein the two connecting devices are fixed on the rod and the fulcrum member moves along the rod and relatively to the connecting devices.

9. The feeding paper apparatus according to claim 8, wherein two sides of each connecting device have a protrusion.

10. The feeding paper apparatus according to claim 9, wherein the buffering device further comprises a main plate and an elastic member and two ends of the elastic member abut against the connecting device and the main plate.

* * * * *